US005202000A

United States Patent [19]

Phillips

[11] Patent Number: 5,202,000

[45] Date of Patent: Apr. 13, 1993

[54] SAVEALL APPARATUS FOR A TWIN-WIRE FORMER

[75] Inventor: Richard W. Phillips, Beloit, Wis.

[73] Assignee: Beloit Technologies, Inc., Wilmington, Del.

[21] Appl. No.: 768,495

[22] Filed: Sep. 30, 1991

[51] Int. Cl.[5] ..... D21F 1/52

[52] U.S. Cl. ..... 162/363; 162/301; 162/374; 162/DIG. 7

[58] Field of Search ..... 162/300, 301, 351, 363, 162/364, DIG. 7, 367, 374

[56] References Cited

U.S. PATENT DOCUMENTS

| | | | |
|---|---|---|---|
| 1,434,318 | 10/1922 | Schwartz | 162/274 |
| 2,142,711 | 1/1939 | Birch | 162/363 |
| 4,648,943 | 3/1987 | Malashenko et al. | 162/300 |

FOREIGN PATENT DOCUMENTS

| | | | |
|---|---|---|---|
| 136000 | 4/1985 | European Pat. Off. | 162/301 |
| 3138133 | 3/1983 | Fed. Rep. of Germany | 162/301 |

*Primary Examiner*—Karen M. Hastings

*Attorney, Agent, or Firm*—Dirk J. Veneman; Raymond W. Campbell; David J. Archer

[57] ABSTRACT

A saveall apparatus is disclosed for collecting water ejected from stock through a forming wire of a papermaking machine. The apparatus includes a box which is disposed closely adjacent to the forming wire. The box defines an enclosure which is connected to a source of partial vacuum so that water ejected from the stock is collected within the enclosure. A throat wall is rigidly secured to the box and has an upstream and a downstream end. The upstream end of the throat wall slidingly engages the forming wire. A moveable throat wall cooperates with the throat wall for defining therebetween a vacuum slot which is connected to the enclosure such that the water ejected from the stock is drawn by the partial vacuum through the vacuum slot into the enclosure. The throat wall is disposed in a first plane, and the moveable throat wall is disposed in a second plane such that when the moveable throat wall is moved relative to the throat wall, an angle defined between the planes remains constant.

15 Claims, 4 Drawing Sheets

SAVEALL APPARATUS FOR A TWIN-WIRE FORMER

BACKGROUND OF THE INVENTION

1. Field of the Invention

The present invention relates to a saveall apparatus for collecting water ejected from stock through a forming wire of a papermaking machine. More particularly, the present invention relates to a vacuum slot for a curved inverted vacuum box of a twin-wire former.

2. Information Disclosure Statement

In the papermaking art, stock is ejected from a headbox onto a moving fourdrinier wire such that water within the stock drains through the moving fourdrinier wire leaving a formed web on the surface of the wire.

Although the aforementioned forming procedure is generally effective for producing linerboard or a web of paper, if such a web is to be subsequently printed thereon, it is desirable that both surfaces of the resultant web should have uniform surface characteristics thereon. However, with the aforementioned drainage of water through a fourdrinier wire, the resultant web exhibits two-sidedness; that is, water is drained from the web in one direction only.

Consequently, more recently, so-called twin-wire formers have been built in which stock is ejected into a forming section defined between a pair of cooperating endless looped wires.

More particularly, water is removed from the stock during passage thereof through the forming section. Such water is squeezed through both wires, particularly when such wires extend around a curved surface guiding the cooperating wires. First, the pressure exerted by the wires on the sandwiched web causes water to be ejected from the formed web. Secondly, when the sandwiched web extends around a curved guide surface, water is thrown centrifugally through the outermost wire during passage around the curve so that a gradual dewatering from both sides of the resultant web can be achieved. Typical of such twin-wire formers is the Horizontal Bel Baie twin-wire former manufactured and sold by Beloit Corporation. The Horizontal Bel Baie is described in U.S. Pat. No. 4,894,120 to North.

Another type of twin-wire former is the BEL BOND former which is a former designed as a retrofit to an existing fourdrinier wire. BEL BOND is a registered trademark of Beloit Corporation. The BEL BOND includes a looped top wire which cooperates with the existing fourdrinier wire and includes a curved inverted vacuum box within the loop of the upper wire.

The curved inverted vacuum box (CIVB) is positioned within the endless loop of the upper wire in order to collect water ejected from the stock through the upper forming wire.

The CIVB essentially includes a box fabricated from stainless steel or the like with the box defining an enclosure connected to a source of partial vacuum. The box includes a base having a convex curved surface for guiding the upper wire so that a portion of water is removed from the formed web downwardly through the fourdrinier wire during movement of the wires over such curved surface.

A vacuum slot is provided at the upstream end of the box for collecting water previously ejected from the stock through the upper wire upstream relative to the CIVB. The vacuum slot is connected to the enclosure such that water is drawn through the vacuum slot up and into the curved inverted vacuum box.

In the prior art vacuum slots, a stationary throat wall, is rigidly secured to the upstream end of the box for initially guiding the top wire under the CIVB.

A moveable throat wall having a first and a second end is pivotally secured at the second end thereof to the box such that controlled pivotal movement of the moveable throat wall varies the cross-sectional area of a vacuum slot defined between the moveable throat wall and the stationary throat wall.

More specifically, a manually operated jack pivotally connected to and extending between the first end of the moveable throat wall and the box enables manual movement of the moveable wall relative to the throat wall for adjusting the flow of water through the vacuum slot.

However, the aforementioned arrangement inherently generates various problems in use thereof. For example, a typical curved inverted vacuum box weighs in the region of 30 tons, and the moveable throat wall thereof may have a width in the region of 40 feet. Therefore, accurate adjustment of the moveable wall relative to the stationary wall is relatively difficult.

Furthermore, with the aforementioned arrangement, there exists a tendency for the moveable wall to inadvertently strike the stationary throat wall upon closure of the vacuum slot.

The present invention provides means for accurately adjusting the position of a moveable throat wall relative to a stationary throat wall of a vacuum slot while preventing damage to the stationary wall by inadvertent striking of the stationary wall by the moveable throat wall.

Therefore, it is a primary objective of the present invention to provide a saveall apparatus which overcomes the aforementioned disadvantages of the prior art proposals and to provide an apparatus which makes a considerable contribution to the art of web formation.

Another objective of the present invention is the provision of a saveall apparatus which includes a throat wall disposed in a first plane and a moveable throat wall disposed in a second plane such that when the moveable throat wall is moved relative to the throat wall, an angle defined between the planes remains constant so that accurate adjustment of the position of the moveable throat wall relative to the throat wall is permitted.

Another object of the present invention is the provision of a saveall apparatus in which striking of the throat wall by the moveable throat wall is prevented.

Other objects and advantages of the present invention will be readily apparent to those skilled in the art by a consideration of the detailed description contained hereinafter, taken in conjunction with the annexed drawings.

SUMMARY OF THE INVENTION

The present invention relates to a saveall apparatus for collecting water ejected from stock through a forming wire of a papermaking machine.

The apparatus includes a box which is disposed closely adjacent to the forming wire. The box defines an enclosure which is connected to a source of partial vacuum such that water ejected from the stock through the forming wire is collected within the enclosure.

A throat wall is rigidly secured to the box with the throat wall having an upstream and a downstream end. The upstream end of the throat wall slidingly engages the forming wire.

A moveable throat wall cooperates with the throat wall for defining therebetween a vacuum slot which is connected to the enclosure such that the water ejected from the stock through the forming wire is drawn by the partial vacuum through the vacuum slot into the enclosure.

The throat wall is disposed in a first plane, and the moveable throat wall is disposed in a second plane such that when the moveable throat wall is moved relative to the throat wall, an angle defined between the planes remains constant.

In a more specific embodiment of the present invention, the box further includes a curved base which guides the forming wire such that the forming wire slides under the curved base.

The curved base is curved convexly and includes a plurality of shoes. Each shoe extends in a cross-machine direction such that the plurality of shoes are disposed parallel and spaced relative to each other in a machine direction.

The throat wall also includes a leading shoe which is rigidly secured to the upstream end of the throat wall. The leading shoe extends in a cross-machine direction for guiding the forming wire and for directing water ejected from the stock through the vacuum slot. The leading shoe is of ceramic material.

The moveable throat wall also includes a first and a second end with the first end of the moveable wall being disposed adjacent to the upstream end of the throat wall. The arrangement is such that when the moveable throat wall is moved relative to the throat wall, the cross-sectional area of the vacuum slot in the vicinity of the first end of the moveable wall varies.

The saveall apparatus also includes a funnel means which extends from the moveable throat wall in a direction generally opposite to the direction of the flow of water ejected from the stock prior to flow thereof through the vacuum slot. The funnel means funnels a primary flow of water ejected from the stock towards the vacuum slot. However, the funnel means also defines a pan for the collection therein of a secondary flow of the water ejected from the stock. Drainage means is connected to the pan for permitting drainage of the secondary flow from the pan.

The apparatus also includes a frame means which is rigidly secured to the moveable throat wall. Bearing means is disposed between the frame means and the box such that the frame means is disposed spaced and parallel relative to the box for spaced parallel sliding movement relative thereto.

More specifically, the bearing means also includes a first and a second bearing journal secured on opposite sides of the frame means in a cross-machine direction.

A first and a second bearing cooperate respectively with the first and the second bearing journals, and a first and second slide block are rigidly secured to the first and second bearings, respectively.

First and second sliding linear bearings are disposed between the first slide block and the box and the second slide block and the box, respectively. The linear bearings permit controlled sliding movement of the frame means and the moveable throat wall attached thereto relative to the throat wall for varying the cross-sectional area of the vacuum slot in the vicinity of the upstream end.

The saveall apparatus also includes stop means disposed between the bearing means and the box for limiting the travel of the frame means such that striking of the throat wall by the moveable wall is prevented.

Additionally, the saveall apparatus includes an indicator means extending between the frame means and the box for indicating the position of the frame means relative to the box.

The apparatus further includes moving means rigidly secured to the box and extending between the box and the frame means for moving the frame means and the moveable throat wall attached thereto relative to the box for varying the cross-sectional area of the vacuum slot in the vicinity of the upstream end.

More particularly, the moving means also includes support bracket means rigidly secured to the box for supporting the moving means, the support bracket means having a distal end.

Jack means having a first and a second extremity are included in the moving means. The first extremity of the jack means is pivotally secured to the distal end of the bracket means. The second extremity of the jack means is pivotally secured to the frame means such that when the moving means is actuated, the frame means slides along the box. The arrangement is such that the moveable throat wall secured to the frame means moves relative to the throat wall for varying the cross-sectional area of the vacuum slot in the vicinity of the upstream end.

The support bracket means includes a plurality of support brackets with each bracket having a distal end.

Also, the jack means includes a plurality of jacks with each jack of the plurality of jacks being pivotally connected to the frame means at respective locations spaced in a cross-machine direction along the frame means for controllably supporting the disposition of the frame means and the moveable throat wall relative to the throat wall.

Control means are connected to each of the plurality of jacks for permitting manual adjustment of the jacks for varying the disposition of the moveable throat wall relative to the throat wall.

In a preferred embodiment of the present invention, the direction of flow of water between the throat wall and the moveable throat wall defines an obtuse angle relative to the direction of flow of the water immediately upstream relative to the upstream end of the throat wall.

Many modifications and variations of the present invention will be readily apparent to those skilled in the art by a consideration of the detailed description contained hereinafter, taken in conjunction with the annexed drawings. However, such modifications and variations do not depart from the spirit and scope of the present invention as defined by the appended claims.

BRIEF DESCRIPTION OF THE DRAWINGS

Similar reference characters refer to similar parts throughout the various views of the drawings.

DETAILED DESCRIPTION OF THE DRAWINGS

Figure 1:
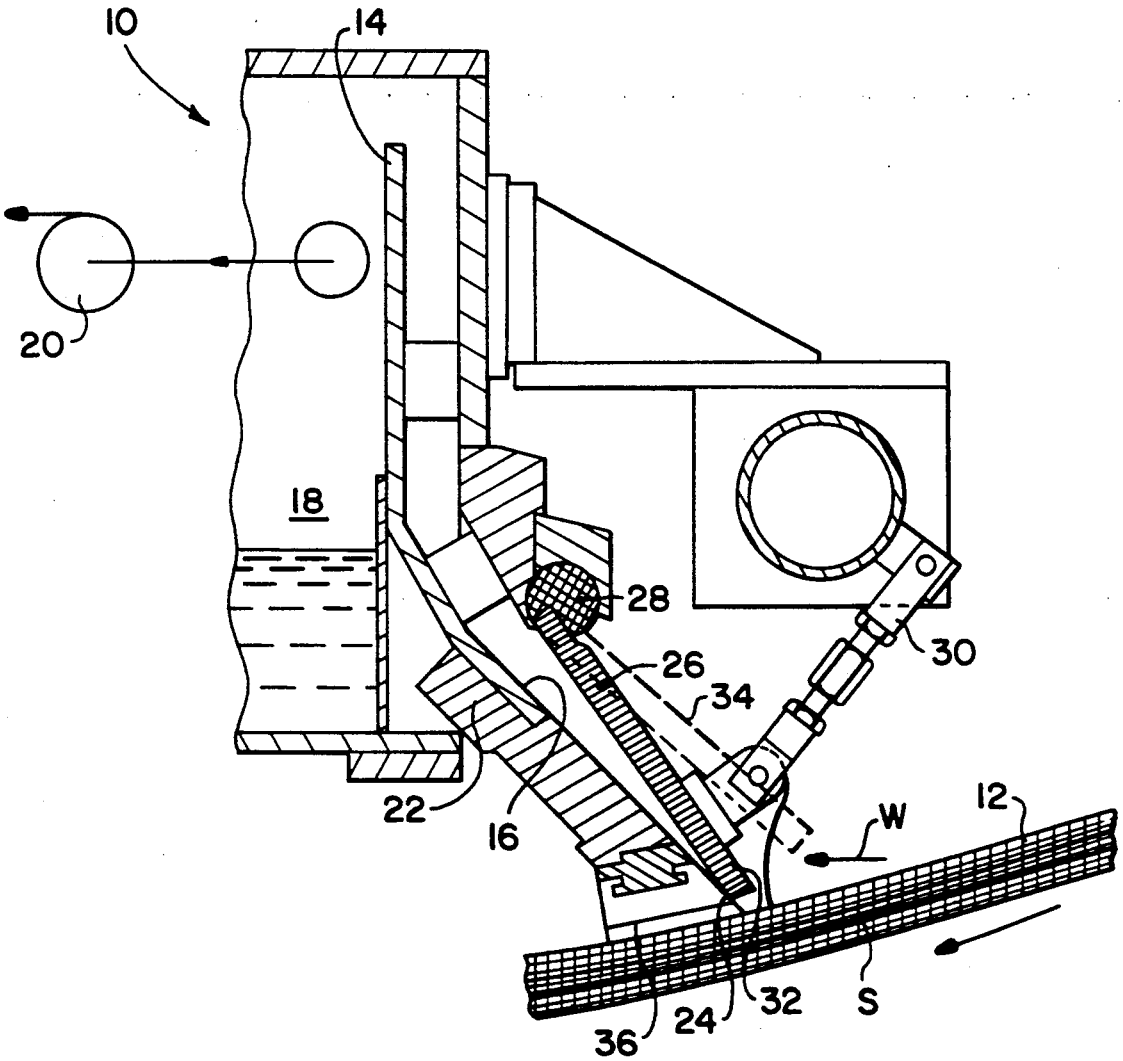
FIG. 1 PRIOR ART
FIG. 1 is a side-elevational view of a portion of a prior art saveall apparatus for collecting water ejected from stock through a forming wire of a twin-wire former, the apparatus having a pivotally mounted moveable throat wall.

FIG. 1 is a side-elevational view of a portion of a typical prior art saveall apparatus, generally designated 10, for collecting water, as indicated by the arrow W, ejected from stock S through a top forming wire 12 of a papermaking machine.

The saveall apparatus 10 shown in FIG. 1 is a curved inverted vacuum box of the type used in a "Horizontal Bel Baie" twin-wire former and as used in the BEL BOND twin-wire former.

The apparatus 10 includes a box 14 which is disposed closely adjacent to the forming wire 12 for guiding the wire 12 thereunder. The water W ejected through the forming wire 12 is drawn through a vacuum slot 16 into an enclosure 18 defined by the box 14. The enclosure 18 is connected to a source of partial vacuum so that the water W is collected within the box 14.

The box 14 includes a throat wall 22 which is rigidly secured to the box 14, with an upstream end 24 of the throat wall 22 slidingly engaging the forming wire 12.

A moveable throat wall 26 is pivotally connected to the box 14 at 28, and a manually adjustable jack 30 extending between a first end 32 of the moveable wall 26 and the box 14 permits pivotal movement of the moveable throat wall 26 to the disposition shown in phantom outline 34 such that the cross-sectional area of the vacuum slot 16 defined between the throat wall 22 and the moveable throat wall 26 can be varied.

As stated hereinbefore, the provision of a pivotally moveable throat wall 26 introduces problems of controllability. More particularly, due to the massive structure of the CIVB and the moveable throat wall 26, accurate adjustment of the moveable throat wall 26 relative to the throat wall 22 is relatively difficult.

Moreover, the aforementioned moveable throat wall 26 may have a cross-machine directional width approaching 40 feet. Therefore, the accurate control of the position of the moveable wall 26 relative to the stationary throat wall 22 along the width of the moveable wall 26 is difficult to accommodate.

Furthermore, there exists a tendency for the moveable wall 26 to strike the stationary throat wall 22, as shown in FIG. 1, thereby causing damage to the upstream end 24 of the stationary wall 22, such end 24 being a leading ceramic shoe 36.

Figure 2:
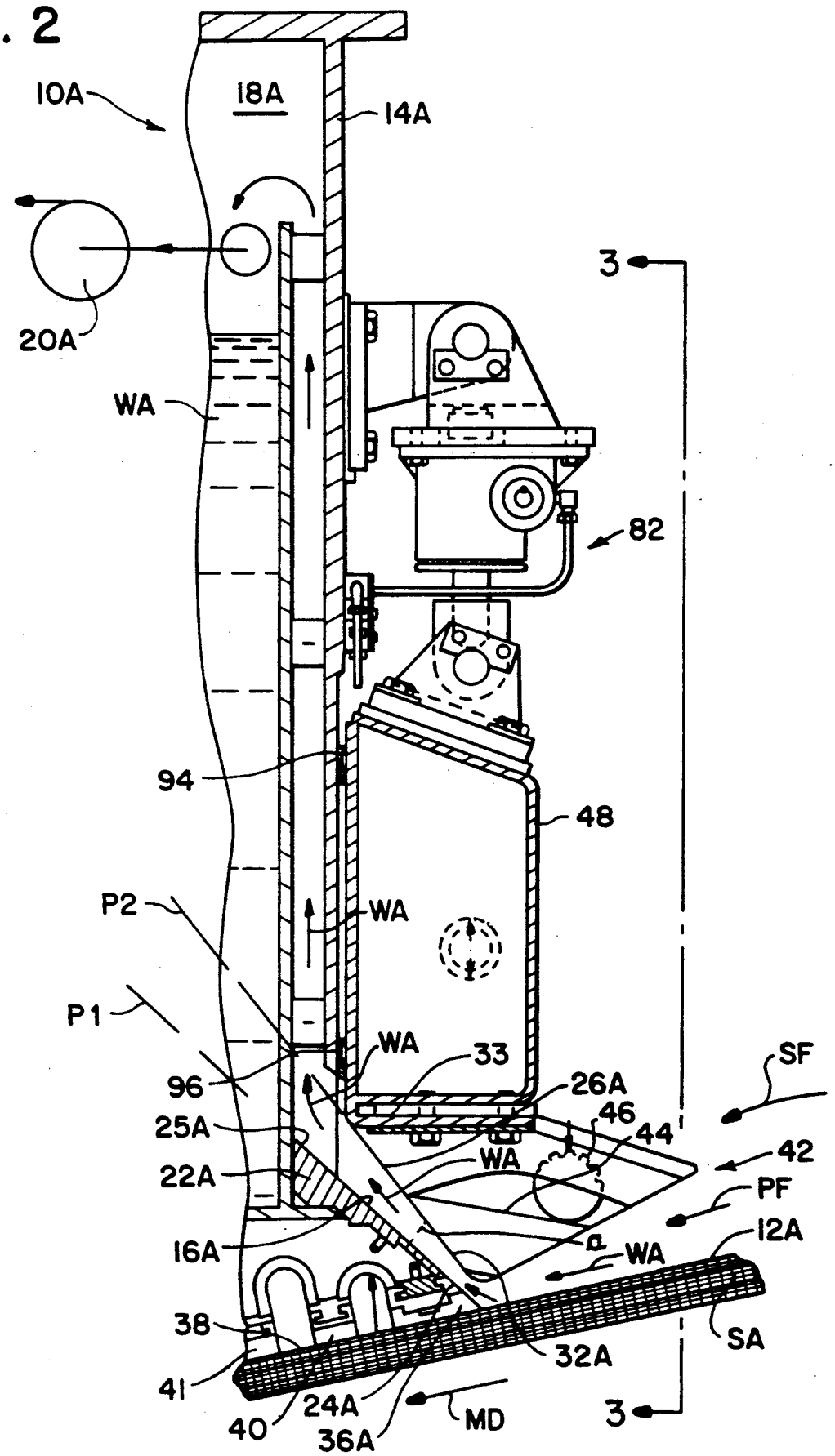
FIG. 2 is a sectional view of a saveall apparatus according to the present invention.

FIG. 2 is a sectional view of a portion of a saveall apparatus, generally designated 10A according to the present invention, which overcomes the aforementioned problems. The apparatus 10A collects water WA ejected from stock SA through a forming wire 12A of a papermaking machine.

The apparatus 10A includes a box 14A which is disposed closely adjacent to the forming wire 12A. The box 14A defines an enclosure 18A which is connected to a source of partial vacuum 20A. The arrangement is such that the water WA ejected from the stock SA through the forming wire 12A is collected within the enclosure 18A.

A throat wall 22A is rigidly secured to the box 14A. The throat wall 22A has an upstream and a downstream end 24A and 25A, respectively. The upstream end 24A of the throat wall 22A slidingly engage the forming wire 12A.

A moveable throat wall 26A cooperates with the throat wall 22A for defining therebetween a vacuum slot 16A. The vacuum slot 16A is connected to the enclosure 18A such that the water WA ejected from the stock SA through the top forming wire 12A is drawn by the partial vacuum 20A through the vacuum slot 16A into the enclosure 18A and is collected as the water WA within the box 14A.

The throat wall 22A is disposed in a first plane P1, and the moveable throat wall 26A is disposed in a second plane P2 such that when the moveable throat wall 26A is moved relative to the throat wall 22A, an angle a defined between the planes P1 and P2 remains constant.

The box 14A also includes a curved base 38 for guiding the forming wire 12A such that the forming wire 12A slides over the base 38.

More particularly, the curved base 38 is curved convexly and includes a plurality of shoes 40 and 41. Each shoe of the plurality of shoes 40 and 41 extends in a cross-machine direction such that the plurality of shoes 40 and 41 are disposed parallel and spaced relative to each other in a machine direction, as indicated by the arrow MD.

The throat wall 22A also includes a leading shoe 36A which is rigidly secured to the upstream end 24A of the throat wall 22A. The leading shoe 36A extends in a cross-machine direction for guiding the forming wire 12A after directing water, as indicated by the arrows WA, ejected from the stock SA through the vacuum slot 16A. Preferably, the leading shoe 36A is of ceramic material.

The moveable throat wall 26A also includes a first and a second end 32A and 33, respectively. The first end 32A of the moveable wall 26A is disposed adjacent to the upstream end 24A of the throat wall 22A such that when the moveable throat wall 26A is moved relative to the throat wall 22A, the cross-sectional area of the vacuum slot 16A in the vicinity of the first end 32A of the moveable wall 26A varies.

The apparatus 10A also includes a funnel means, generally designated 42, which extends from the moveable throat wall 26A in a direction generally opposite to the direction WA of the flow of water ejected from the stock SA prior to flow thereof through the vacuum slot 16A. The funnel means 42 funnels a primary flow, as indicated by the arrow PF, of the water ejected from the stock towards the vacuum slot 16A. The funnel means 42 also defines a pan 44 for the collection therein of a secondary flow, as indicated by the arrow SF, of the water ejected from the stock.

The funnel means 42 also includes drainage means 46 connected to the pan 44 for permitting drainage of the secondary flow SF from the pan 44.

Figure 3:
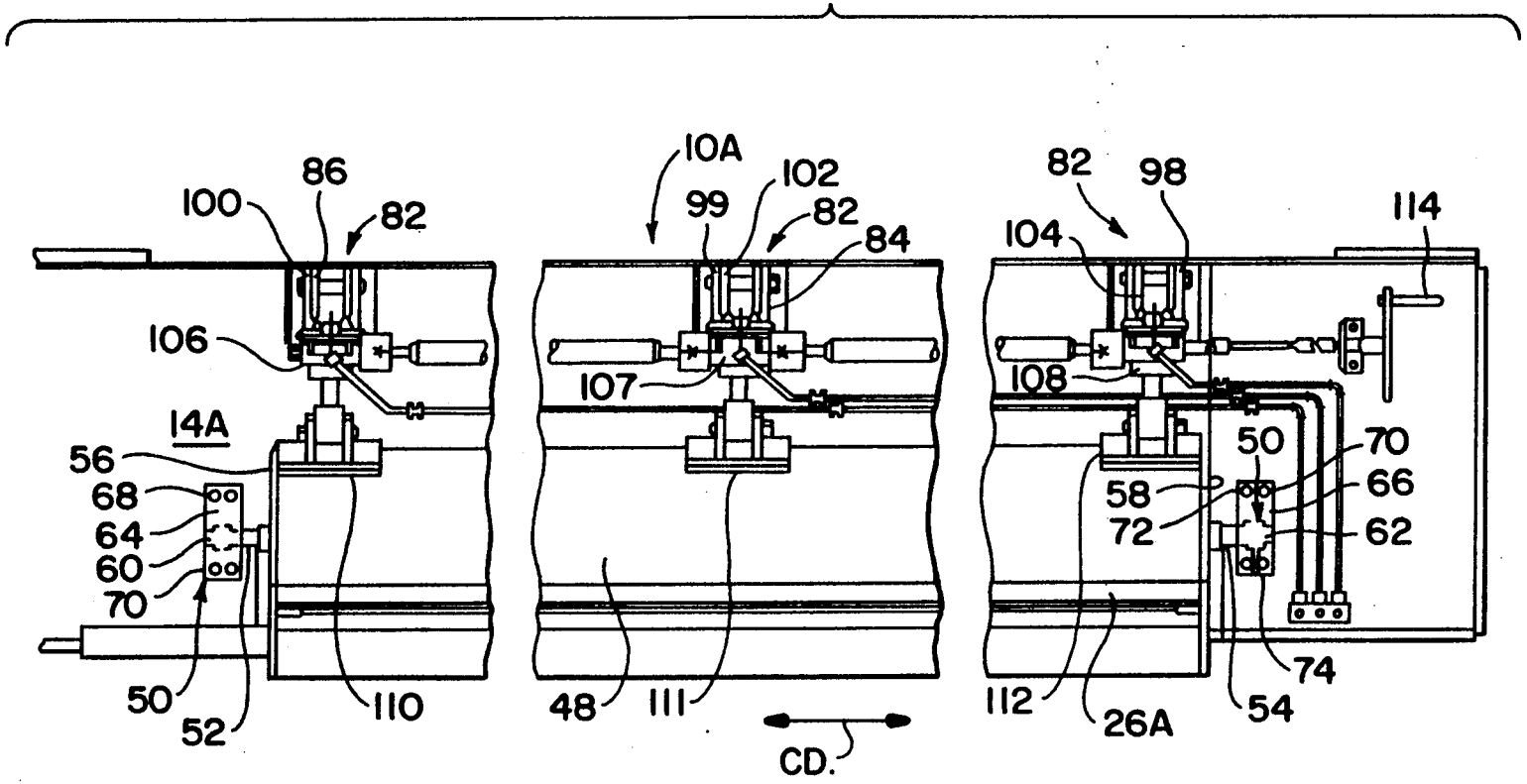
FIG. 3 is a view on a reduced scale taken on the line 3—3 shown in FIG. 2.

FIG. 3 is a view, on a reduced scale, taken on the line 3—3 shown in FIG. 2 and shows the apparatus 10A as including frame means 48 rigidly secured to the moveable throat wall 26A.

Bearing means, generally designated 50, are disposed between the frame means 48 and the box 14A such that the frame means 48 is disposed spaced and parallel relative to the box 14A for spaced parallel sliding movement relative to the box 14A as shown in FIG. 2.

Figure 4:
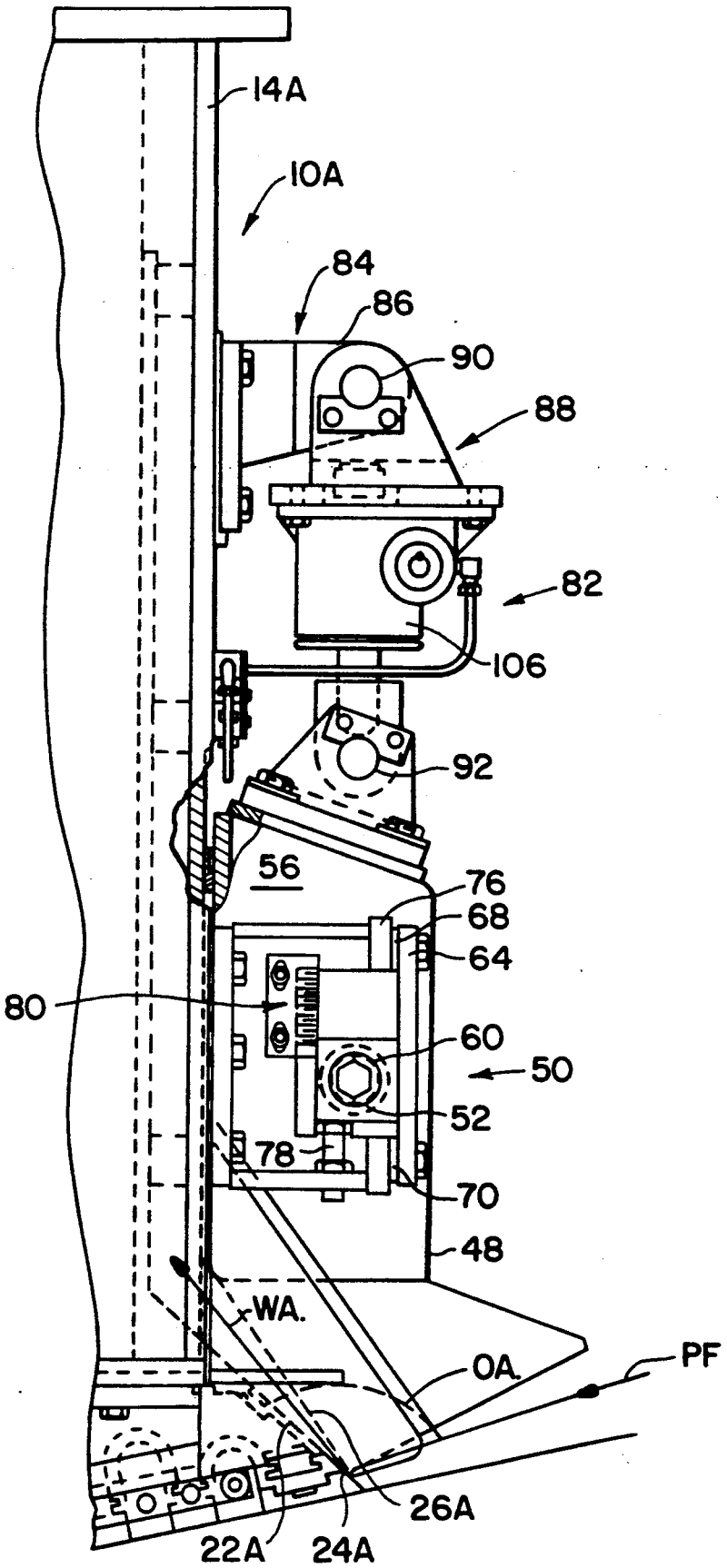
FIG. 4 is a side-elevational view of the apparatus shown in FIG. 2.

FIG. 4 is a side-elevational view of the apparatus 10A shown in FIG. 2.

More specifically, as shown in FIGS. 3 and 4, the bearing means 50 includes a first and a second bearing journal 52 and 54, respectively, secured on opposite sides 56 and 58, respectively, of the frame means 48 in a cross-machine direction, as indicated by the arrow CD.

A first and second bearing 60 and 62, respectively, cooperate respectively with the first and second bearing journals 52 and 54.

A first and second slide block 64 and 66, respectively, are rigidly secured to the first and second bearings 60 and 62, respectively.

First and second sliding linear bearings 68 and 70 are disposed between the first slide block 64 and the box 14A. Also, further linear bearings 72 and 74 are disposed between the second slide block 66 and the box 14A, respectively, as shown in FIG. 3. More specifically, the bearings 68,70,72 and 74 slidingly cooperate with extensions 76 of the box 14A, as shown in FIG. 4. The sliding linear bearings 68,70,72 and 74 permit controlled sliding movement of the frame means 48 and the moveable throat wall 26A attached thereto relative to the throat wall 22A for varying the cross-sectional area of the vacuum slot 16A in the vicinity of the upstream end 24A of the stationary wall 22A.

FIG. 4 also shows the apparatus 10A as further including stop means 78 disposed between the bearing means 50 and the box 14A for limiting the travel of the frame means 48 such that striking of the throat wall 22A by the moveable wall 26A is prevented.

As shown in FIG. 4, the apparatus 10A also includes indicator means 80 extending between the frame means 48 and the box 14A for indicating the position of the frame means 48 relative to the box 14A.

The saveall apparatus 10A shown in FIGS. 2–4 also includes moving means, generally designated 82, rigidly secured to the box 14A and extending between the box 14A and the frame means 48 for moving the frame means 48 and the moveable throat wall 26A attached thereto relative to the box 14A for varying the cross-sectional area of the vacuum slot 16A in the vicinity of the upstream end 24A.

More specifically, the moving means 82 further includes support bracket means, generally designated 84, rigidly secured to the box 14A for supporting the moving means 82. The support bracket means 84 includes a distal end 86, as shown in FIG. 4.

Jack means, generally designated 88, having a first and a second extremity 90 and 92, respectively, is disposed such that the first extremity 90 is pivotally secured to the distal end 86 of the bracket means 84. The second extremity 92 of the jack means 88 is pivotally secured to the frame means 48. The arrangement is such that when the moving means 82 is actuated, the frame means 48 by means of slides 94 and 96, as shown in FIG. 2, slides along the box 14A so that the moveable throat wall 26A secured to the frame means 48 relative to the throat wall 22A for varying the cross-sectional area of the vacuum slot 16A in the vicinity of the upstream end 24A.

The support bracket means 84 specifically includes a plurality of support brackets 98,99 and 100, as shown in FIG. 3, with each bracket 98 to 100 having a distal end 86,102 and 104.

The jack means 88 also specifically includes a plurality of jacks 106,107 and 108 with each jack 106 to 108 of the plurality of jacks 106 to 108 being pivotally connected to the frame means 48 at respective locations 110,111 and 112 spaced in a cross-machine direction CD along the frame means 48 for controllably supporting the disposition of the frame means 48 and the moveable throat wall 26A relative to the throat wall 22A.

Control means, including a manual handwheel 114, is connected to each of the plurality of jacks 106 to 108 for permitting manual adjustment of the jacks 106 to 108 for varying the disposition of the moveable throat wall 26A relative to the throat wall 22A.

As shown in FIG. 2, the direction WA of the flow of water between the throat wall 22A and the moveable throat wall 26A defines an obtuse angle OA relative to the direction PF of the flow of the water immediately upstream relative to the upstream end 24 of the throat wall 22A.

The present invention provides an accurate means for controlling the movement of a moveable throat wall relative to a stationary throat wall of a vacuum slot in a curved inverted vacuum box.

Additionally, the present invention prevents the inadvertent striking of the stationary throat wall by the moveable throat wall, thereby preventing damage thereof.

What is claimed is:

1. A saveall apparatus for collecting water ejected from stock through a forming wire of a papermaking machine, said apparatus comprising:

a box disposed closely adjacent to the forming wire, said box defining an enclosure which is connected to a source of partial vacuum such that the water ejected from the stock through the forming wire is collected within said enclosure;

a fixed throat rigidly secured to said box, said fixed throat wall having an upstream and a downstream end, said upstream end of said fixed throat wall slidingly engaging the forming wire;

a movable throat wall cooperating with said fixed throat wall for defining therebetween a vacuum slot which is connected to said enclosure such that the water ejected from the stock through the forming wire is drawn by said partial vacuum through said vacuum slot into said enclosure;

said fixed throat wall being disposed in a first plane and said movable throat wall being disposed in a second plane at an angle to said first plane;

means for moving said movable throat wall relative to said fixed throat wall, structured and arranged such that the angle defined between said first and second planes remains constant;

frame means rigidly secured to said moveable throat wall; and bearing means disposed between said frame means and said box such that said frame means is disposed spaced and parallel relative to said box for spaced parallel sliding movement relative thereto.

2. A saveall apparatus as set forth in claim 1 wherein said box further includes:

a curved base for guiding the forming wire such that the forming wire slides thereover.

3. A saveall apparatus as set forth in claim 2 wherein said curved base is curved convexly;

said curved base further including:

a plurality of shoes, each shoe extending in a cross-machine direction such that said plurality of shoes are disposed parallel and spaced relative to each other in a machine direction.

4. A saveall apparatus as set forth in claim 1 wherein said fixed throat wall further includes:

a leading shoe rigidly secured to said upstream end of said fixed throat wall, said leading shoe extending in a cross-machine direction for guiding the forming wire and for directing water ejected from the stock through said vacuum slot.

5. A saveall apparatus as set forth in claim 4 wherein said leading shoe is of ceramic material.

6. A saveall apparatus as set forth in claim 1 wherein said moveable throat wall further includes:

a first and a second end, said first end of said moveable wall being disposed adjacent to said upstream end of said fixed throat wall such that when said moveable throat wall is moved relative to said fixed throat wall, the cross-sectional area of said vacuum slot in the vicinity of said first end of said moveable wall varies.

7. A saveall apparatus as set forth in claim 1 further including:

a funnel means extending from said moveable throat wall in a direction generally opposite to the direction of the flow of water ejected from the stock prior to flow thereof through said vacuum slot, said funnel means funnelling a primary flow of the water ejected from the stock towards said vacuum slot, said funnel means also defining a pan for the collection therein of a secondary flow of the water ejected from the stock.

8. A saveall apparatus as set forth in claim 7 wherein said funnel means further includes:

drainage means connected to said pan for permitting drainage of said secondary flow from said pan.

9. A saveall apparatus as set forth in claim 1 wherein said bearing means further includes:

a first and a second bearing journal secured on opposite sides of said frame means in a cross-machine direction;

a first and second bearing cooperating respectively with said first and second bearing journals;

a first and second slide block rigidly secured to said first and second bearing, respectively;

first and second sliding linear bearings disposed between said first slide block and said box and said second slide block and said box, respectively, for permitting controlled sliding movement of said frame means and said moveable throat wall attached thereto relative to said throat wall for varying the cross-sectional area of said vacuum slot in the vicinity of said upstream end.

10. A saveall apparatus as set forth in claim 1 further including:

stop means disposed between said bearing means and said box for limiting the travel of said frame means such that striking of said fixed throat wall by said moveable wall is prevented.

11. A saveall apparatus as set forth in claim 1 further including:

indicator means extending between said frame means and said box for indicating the position of said frame means relative to said box.

12. A saveall apparatus as set forth in claim 9 wherein said moving means is rigidly secured to said box and extending between said box and said frame means for moving said frame means and said moveable throat wall attached thereto relative to said box for varying the cross-sectional area of said vacuum slot in the vicinity of said upstream end.

13. A saveall apparatus as set forth in claim 12 wherein said moving means further includes:

support bracket means rigidly secured to said box for supporting said moving means, said support bracket means having a distal end;

jack means having a first and second extremity, said first extremity being pivotally secured to said distal end of said bracket means, said second extremity being pivotally secured to said frame means such that when said moving means is actuated, said frame means slides along said box so that said moveable throat wall secured to said frame means moves relative to said fixed throat wall for varying the cross-sectional area of said vacuum slot in the vicinity of said upstream end.

14. A saveall apparatus as set forth in claim 13 wherein said support bracket means includes:

a plurality of support brackets, each bracket having a distal end;

said jack means including:

a plurality of jacks, each jack of said plurality of jacks being pivotally connected to said frame means at respective locations spaced in a cross-machine direction along said frame means for controllably supporting the disposition of said frame means and said moveable throat wall relative to said fixed throat wall;

control means connected to each of said plurality of jacks for permitting manual adjustment of said jacks for varying the disposition of said moveable throat wall relative to said fixed throat wall.

15. A saveall apparatus as set forth in claim 1 wherein the direction of flow of the water between said fixed throat wall and said moveable throat wall defines an obtuse angle relative to the direction of flow of the water immediately upstream relative to said upstream end of said fixed throat wall.

* * * * *

UNITED STATES PATENT AND TRADEMARK OFFICE

CERTIFICATE OF CORRECTION

PATENT NO. : 5,202,000
DATED : April 13, 1993
INVENTOR(S) : Richard W. Phillips

It is certified that error appears in the above-indentified patent and that said Letters Patent is hereby corrected as shown below:

Column 8, line 8, "24" should read --24A--.

Signed and Sealed this

Eleventh Day of January, 1994

*Attest:*

*Attesting Officer*

BRUCE LEHMAN

*Commissioner of Patents and Trademarks*